US011092301B2

(12) United States Patent
Zheng et al.

(10) Patent No.: US 11,092,301 B2
(45) Date of Patent: Aug. 17, 2021

(54) STARRY PROJECTION LAMP

(71) Applicant: SHENZHEN BOLONG TECHNOLOGY CO., LTD., Shenzhen (CN)

(72) Inventors: Huazhu Zheng, Shenzhen (CN); Yunyun Lu, Shenzhen (CN); Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/170,927

(22) Filed: Feb. 9, 2021

(65) Prior Publication Data

US 2021/0164628 A1 Jun. 3, 2021

(30) Foreign Application Priority Data

Jan. 15, 2021 (CN) ..... 202110055679.4

(51) Int. Cl.

| | |
|---|---|
| ***F21S 10/00*** | (2006.01) |
| ***F21S 10/06*** | (2006.01) |
| ***F21V 3/04*** | (2018.01) |
| ***F21V 5/02*** | (2006.01) |
| ***F21V 33/00*** | (2006.01) |
| ***F21Y 115/10*** | (2016.01) |

(52) U.S. Cl.

CPC ..... *F21S 10/002* (2013.01); *F21S 10/007* (2013.01); *F21S 10/063* (2013.01); *F21V 3/04* (2013.01); *F21V 5/02* (2013.01); *F21V 33/0056* (2013.01); *F21Y 2115/10* (2016.08)

(58) Field of Classification Search

CPC ..... F21S 10/00; F21S 10/007; F21S 6/002; F21V 33/0056

See application file for complete search history.

(56) References Cited

U.S. PATENT DOCUMENTS

| | | | | |
|---|---|---|---|---|
| 3,538,323 | A * | 11/1970 | Ziegler | F21V 3/00 362/293 |
| 3,949,350 | A * | 4/1976 | Smith | F21S 6/002 362/86 |
| 4,847,739 | A * | 7/1989 | Saraceni | F21S 10/02 362/232 |
| 10,830,410 | B1 * | 11/2020 | Wei | F21V 11/16 |
| 2007/0097681 | A1 * | 5/2007 | Chich | F21S 10/00 362/232 |
| 2013/0170229 | A1 | 7/2013 | Hsieh et al. | |
| 2014/0226328 | A1 | 8/2014 | Schwarz | |
| 2014/0328085 | A1 * | 11/2014 | Johnson | F21V 13/02 362/644 |
| 2015/0131288 | A1 * | 5/2015 | Zhang | F21S 8/00 362/277 |
| 2015/0184844 | A1 * | 7/2015 | Zhang | F21V 13/02 362/96 |
| 2016/0069541 | A1 | 3/2016 | Huang | |
| 2017/0219176 | A1 * | 8/2017 | Chang | F21V 21/0824 |
| 2017/0241623 | A1 * | 8/2017 | Zhang | F21V 31/005 |
| 2018/0013986 | A1 * | 1/2018 | Chien | F21V 33/0052 |
| 2019/0078768 | A1 * | 3/2019 | Altamura | F21S 10/063 |

* cited by examiner

*Primary Examiner* — Alexander K Garlen

(74) *Attorney, Agent, or Firm* — HYIP

(57) ABSTRACT

The present disclosure relates to a starry projection lamp, including an upper shell, a lower shell, a light-emitting light path system, a laser light path system, and a main control board. The light-emitting light path system is rotatably disposed to cause imaged water ripples to rotate; and an audio component provided can bring visual and auditory enjoyment to a user to make the user get relaxed more easily.

9 Claims, 3 Drawing Sheets

STARRY PROJECTION LAMP

TECHNICAL FIELD

The present disclosure relates to a projection device, and in particular, a starry projection lamp.

BACKGROUND

With the development of the society, people have higher and higher requirements for the living standards, and more and more people begin to pursue the quality of life. For example: People begin to pay attention to lighting fixtures, but current lighting fixtures on the market only have a lighting function. Light elements emitted are single, and the lighting atmosphere is monotonous. It is easy for users to experience visual aesthetic fatigue. People have more requirements for lighting atmospheres with the improvement of the living quality of people. Lighting fixtures that can only emit monotonous light are not enough to satisfy people's needs. People begin to pay attention to lighting fixtures that can create a marvelous lighting atmosphere. Therefore, there is an urgent need for, a lighting fixture on the market, which can create a marvelous lighting atmosphere to meet the needs of people.

SUMMARY

In order to overcome the deficiencies in the prior art, the present disclosure provides a starry projection lamp which not only has a lighting function, but also can create a starry atmosphere with dynamic water ripples to bring, a visual enjoyment to users.

A technical solution of the present disclosure adopted to solve the technical problem is that: A starry projection lamp includes an upper shell, a lower shell, a light-emitting light path system used for emitting water ripple light, a laser light path system used for emitting starriness light, and a main control board. The lower shell is provided with a first accommodating cavity; the light-emitting light path system is rotatably disposed; the light-emitting light path system and the laser light path system are arranged in the first accommodating cavity; the upper shell is provided with a first light outlet and a second light outlet; the first light outlet is provided with a light-transmittance optical lens; a plurality of polyhedral vertebral prisms are distributed on an inner surface of the optical lens; a light-emitting surface of the light-emitting light path system faces the polyhedral vertebral prisms; a light-emitting surface of the laser light path system faces the second light outlet; a loudspeaker is also arranged, in the first accommodating cavity; a communication module and an audio module are arranged on the main control board; and the loudspeaker is electrically connected to the main control board.

In one of the embodiments, the light-emitting light path system includes an aluminum base plate, a water ripple sheet and a driving component; a plurality of LED lamps are arranged on the aluminum base plate; light-emitting surfaces of the LED lamps face an illuminated surface of the water ripple sheet; a light-emitting surface of the water ripple sheet faces the polyhedral vertebral prisms; the driving component includes a motor and an output shaft; the aluminum base plate is sleeved on the output shaft; and the output shaft resists against the water ripple sheet.

In one of the embodiments, a motor fixing seat is also arranged in the first accommodating cavity; the motor fixing seat is provided with a second accommodating cavity; a groove and a boss arranged on the groove are arranged in the second accommodating cavity; the motor is arranged on the groove; the light-emitting light path system is arranged on the boss by means of the aluminum base plate; when the upper shell covers the lower shell, the upper shell presses the optical lens on the motor fixing seat; and the motor fixing seat is fixed on the lower shell.

In one of the embodiments, the motor fixing seat is also symmetrically provided with sound cavities; the sound cavities are arranged on two sides of the second accommodating cavity; two loudspeakers are provided, and are respectively arranged in the sound cavities.

In one of the embodiments, a side wall of the lower shell has audio openings, and the loudspeakers face the audio openings.

In one of the embodiments, four LED lamps are provided, and the LED lamps are uniformly distributed around a center of the aluminum base plate.

In one of the embodiments, the laser light path system includes a laser device and a grating sheet; a grating sheet pad is arranged on the laser device; the grating sheet is connected with the grating sheet pad; an illuminated surface of the grating sheet faces a light-emitting surface of the laser device; a light-emitting surface of the gating sheet, faces the second light outlet; and a side wall of the laser device is provided with a heat dissipater used for heat dissipation of the laser device.

In one of the embodiments, the outline of the optical lens is shaped like a semicircular sphere, and a spherical outer surface of the optical lens is a gain-free smooth surface; and the plurality of polyhedral vertebral prisms are uniformly distributed on a spherical inner surface of the optical lens.

In one of the embodiments, the polyhedral vertebral prism is formed by splicing a plurality of triangular mirrors; the mirrors of the polyhedral vertebral prism are divided into a plurality of groups of triangles which are distributed towards an edge along a center of the spherical inner surface of the optical lens, and bottom sides of each group of triangles are spliced to form a dodecagon.

In one of the embodiments, the communication module includes a Bluetooth module and a module; a USB module is also arranged on the main control board; and both the light-emitting light path system and the laser light path system are electrically connected to the main control board.

The present disclosure has the beneficial effects that the present disclosure provides the starry projection lamp. By means of the above-mentioned structure, due to the arrangement of the laser light path system, the static starriness light emitted by the laser light path system may be projected to the outside via the second light outlet to create a marvelous starry atmosphere; due to the arrangement of the light-emitting light path system, the water ripple light, emitted by the light-emitting light path system is reflected and refracted via the polyhedral vertebral prisms, and several groups of prism surfaces can form alternation of the light to form a plurality of colourful water ripple patterns which are projected to the outside; furthermore, the light-emitting light path system is rotatably disposed to cause imaged water ripples to rotate to show a dynamic water ripple pattern, and the water ripple atmosphere is more irregular; at the same time, the loudspeakers are connected to the audio module of the main control board, so that when using starry projection, user can play audios to create an atmosphere with music and dynamic water ripple and static starriness patterns, and can get lost in the music and light atmosphere to get a full range of relaxation and enjoyment.

BRIEF DESCRIPTION OF THE DRAWINGS

The present disclosure is further described below in combination with the accompanying drawings and embodiments. In the drawing.

Figure 1:
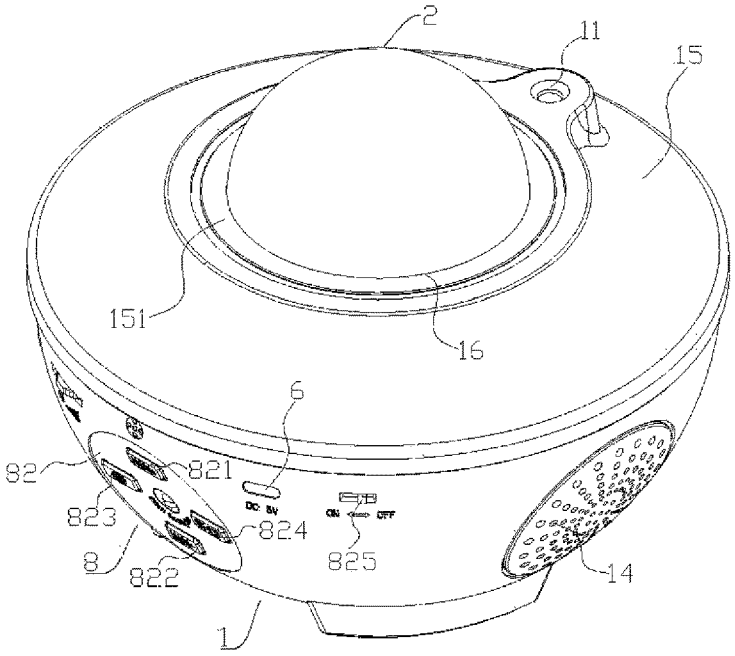
FIG. 1 is a schematic diagram of an entire structure of the present disclosure.

15: Upper shell; 1: lower shell; 3: light-emitting light path system; 31: aluminum base plate; 32: water ripple sheet: 311: LED lamp; 4: laser light path system; 41: laser device; 42: grating sheet; 411: grating sheet pad; 412: heat dissipater; 5: driving component; 51: motor; 511: output shaft; 7: first accommodating cavity; 16: first light outlet; 11: second light outlet; 2: optical lens; 21: polyhedral vertebral prism; 82: main control board; 12: motor fixing seat; 121: sound cavity; 122: groove; 123: boss; 13: loudspeaker; 22: first block edge; 151: second block edge; 14: audio opening; 8: key component 81: key; 821: volume up key/next song key; 822: volume down/previous song key; 823: audio pause key; 824: USB/Bluetooth switch key; 825: master light switch; 826: light brightness adjustment key; 827: sound receiving hole; 828: wireless remote control receiving head; 6: charging port.

DESCRIPTION OF THE EMBODIMENTS

Now to make the technical problems, technical solutions and beneficial effects of the present disclosure clearer, the present disclosure is further described below in detail with reference to accompanying drawings and embodiments. It should be understood that the specific embodiments described here are merely to explain the present disclosure, and not intended to limit the present disclosure.

Referring to FIG. 1 to FIG. 7, a starry projection lamp includes an upper shell 15, a lower shell 1, a light-emitting light path system 3, a laser light path system 4, and a main control board 82. The light-emitting light path system. 3 is used for emitting water ripple light, and the light-emitting light path system 3 is rotatably disposed; and the laser light path system 4 is used for emitting static starriness light. The lower shell 1 has a first accommodating cavity 7; both the light-emitting light path system 3 and the laser light path system 4 are arranged in the first accommodating cavity 7; the upper shell 15 is provided with a first light outlet 16 and a second light outlet 11; the first light outlet 16 is provided with a light-transmittance optical lens 2; a plurality of polyhedral vertebral prisms 21 are distributed on an inner surface of the optical lens 2; a light-emitting surface of the light-emitting light path system 3 faces the polyhedral vertebral prisms 21; a light-emitting surface of the laser light path system 4 faces the second light outlet 11; a loudspeaker 13 is also arranged in the first accommodating cavity 7; a communication module and an audio module are arranged on the main control board 82; and the loudspeaker 13 is electrically connected to the main control board 82.

By means of the above structure, due to the arrangement of the laser light path system 4, the laser light path system 4 is used for emitting the static starriness light, and the light-emitting surface of the laser light path system 4 faces the second light outlet 11, so that the starriness light emitted by the laser light path system 4 may be projected to the outside via the light outlet to create a marvelous starry atmosphere. Further, due to the arrangement of the light-emitting light path system 3, the light-emitting light path system 3 is used for emitting the water ripple light, and the light-emitting surface of the light-emitting light path system 3 faces the polyhedral vertebral prisms 21 provided at the first light outlet 16, so that the water ripple light emitted by the light-emitting light path system 3 is reflected and refracted via the polyhedral vertebral prisms 21, and several groups of prism surfaces can form alternation of the light to form a plurality of colourful water ripple patterns which are projected to the outside to show a fantastic starry atmosphere with water ripples. Further, Since the light-emitting light path system 3 is rotatably disposed the imaged water ripples to rotate to show a dynamic water ripple pattern, the water ripple atmosphere is more irregular and more colourful, which enhances the water ripple projection effect, brings a visual enjoyment to users and makes the users get relaxed more easily; at the same time, the loudspeaker is connected to the audio module of the main control board, so that when using starlight projection, the user can play audios to create an atmosphere with music and dynamic water ripple and starry patterns, and can get lost in the music and light atmosphere to get a full range of relaxation and enjoy and experience the atmosphere. The communication module can realize communication connection between the starry projection lamp and an external device (such as an intelligent mobile terminal), so as to control a product by means of the external device to realize intelligence.

Figure 2:
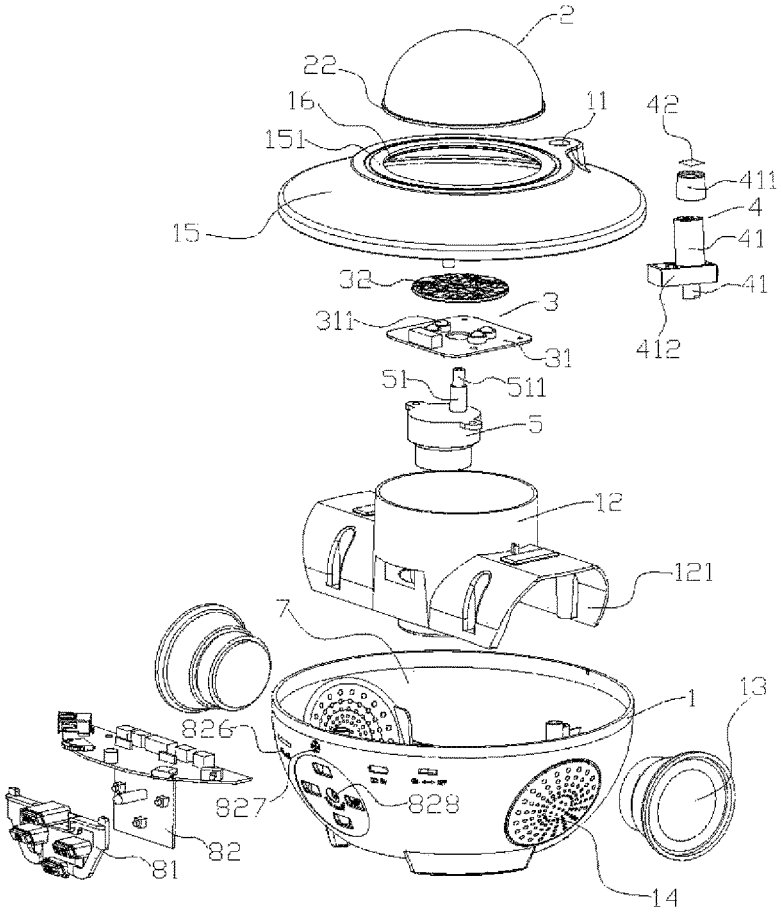
FIG. 2 is an exploded diagram of the present disclosure.
Figure 3:
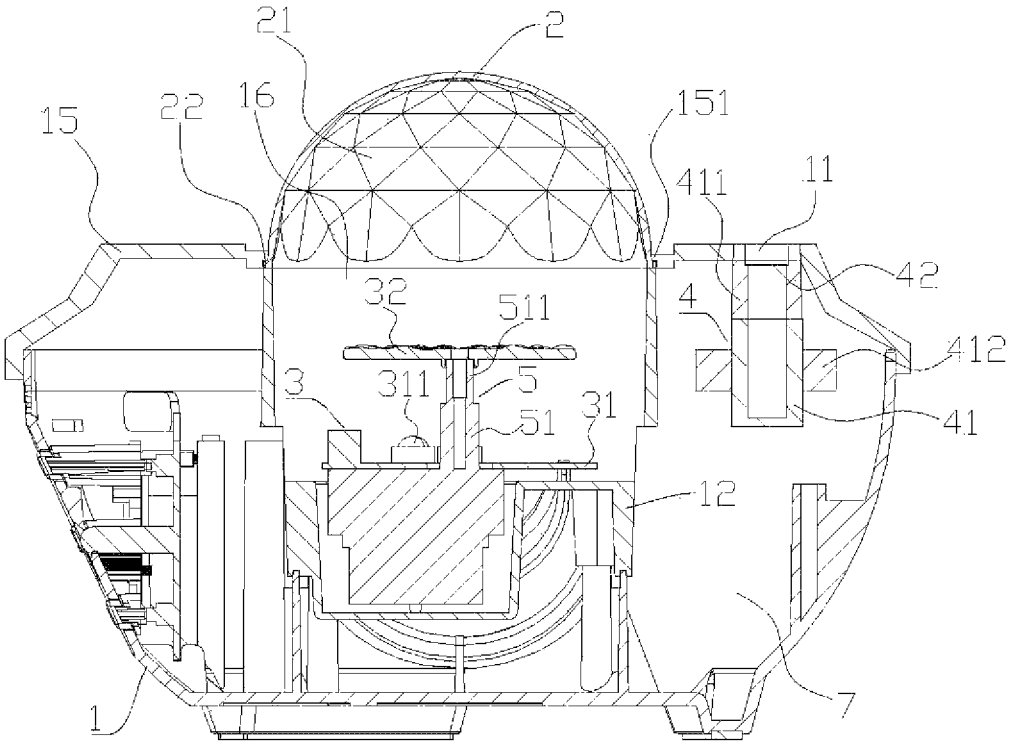
FIG. 3 is a cut-away view obtained by sectioning along a light outlet.
Figure 4:
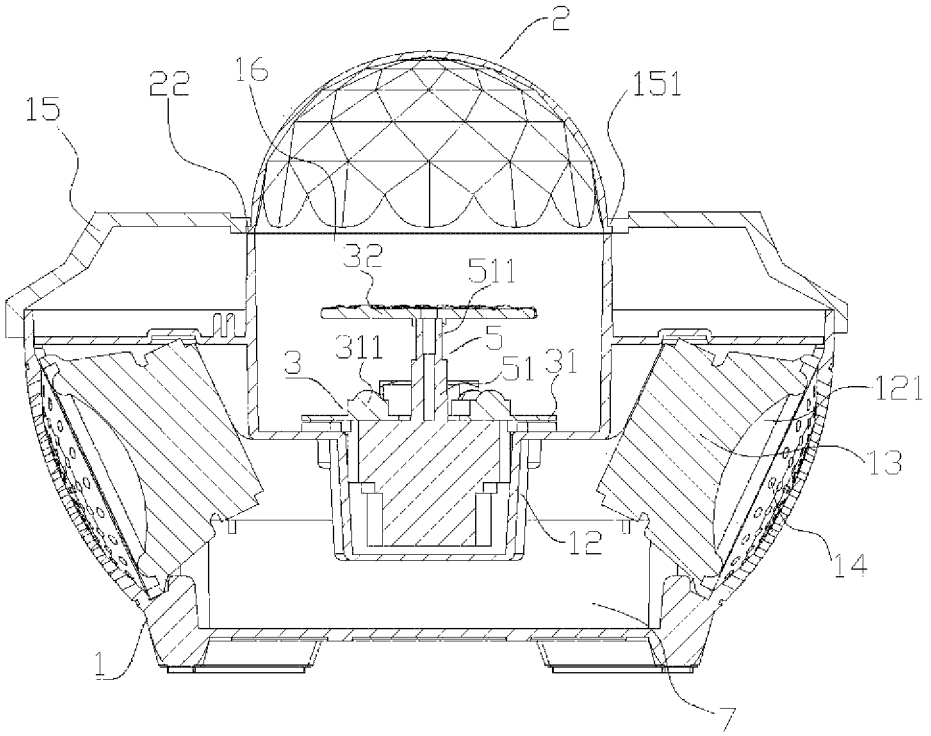
FIG. 4 is a cut-away view obtained by sectioning along a loudspeaker.

With reference to FIG. 2 to FIG. 4, in the present embodiment, the light-emitting light path system 3 includes an aluminum base plate 31, a water ripple sheet 32 and a driving component 5. The aluminum base plate 31 is provided with a plurality of LED lamps 311; light-emitting surfaces of the LED lamps 311 face an illuminated surface of the water ripple sheet 32; a light-emitting surface of the water ripple sheet 32 faces the polyhedral vertebral prisms 21; the driving component 5 includes a motor 51 and an output shaft 511; the aluminum base plate 31 is sleeved on the output shaft 511; and the output shaft 511 resists against the water ripple sheet 32.

By means of the above-mentioned structure, since the light-emitting surfaces of the LED lamps 311 face the water ripple sheet 32, when light emitted by the LED lamps 311 is transmitted through the water ripple sheet 32, a water ripple light pattern is formed. The water ripple light pattern is reflected and refracted by the polyhedral vertebral prisms 21; several groups of prism surfaces can form alternation of light to form a plurality of colourful water ripple patterns which are projected to the outside. Further, since the driving component 5 includes the motor 51 and the output shaft 511, and both the aluminum base plate 31 and the water ripple sheet 32 are in transmission connection to the motor 51, a rotation function of the light-emitting light path system 3 is realized to drive the water ripple light patterns emitted by the light-emitting light path system to rotate to be intertwined with starriness light patterns to show a marvelous starry atmosphere with the dynamic water ripple light patterns, which simulates a real water ripple effect, makes a user have a feeling of being there and making the user relax and enjoy mentally.

Further, a surface of the water ripple sheet 32 facing the LED lamps 311 is a smooth surface, and a surface of the water ripple sheet 32 facing the upper shell 15 is a rugged water ripple surface, so that when transmitted through the water ripple sheet 32, the light emitted by the LED lamps 311 is refracted by the water ripple sheet 32 to form the water ripple light patterns.

Further, the motor 51 may rotate clockwise to show the fantastic light atmosphere with the water ripple patterns and the starry patterns.

In the present embodiment, there are four LED lamps 311, and the LED lamps 311 are uniformly distributed around a center of the aluminum base plate 31. By means of the above-mentioned structure, since there are four LED lamps 311 uniformly distributed around the center of the aluminum base plate 31, the LED lamps 311 emit four light beams, and the four light beams can be formed by single-color or multi-color lamp beads, and are transmitted through the water ripple sheet 32 to cause that a projection area of the created water ripple pattern is larger to greatly simulate a water ripple effect.

With reference to FIG. 3, the laser light path system 4 includes a laser device 41 and a grating sheet 42; a grating sheet pad 411 is arranged on the laser device 41; the grating sheet 42 is connected with the grating sheet pad 411; an illuminated surface of the grating sheet 42 faces a light-emitting surface of the laser device 41; a light-emitting surface of the grating sheet 42 faces the second light outlet 11; a side wall of the laser device 41 is provided with a heat dissipater 412; and the heat dissipater 412 is used for heat dissipation of the laser device 41.

The grating sheet 42 is a starry pattern; laser emitted by the laser device 41 is refracted by the starry pattern grating sheet 42 to form starry light; the starry light is projected to the outside through the light outlets to create static starry light atmosphere, which greatly enhances the visual experience of the user and makes the user pleasant.

Figure 6:
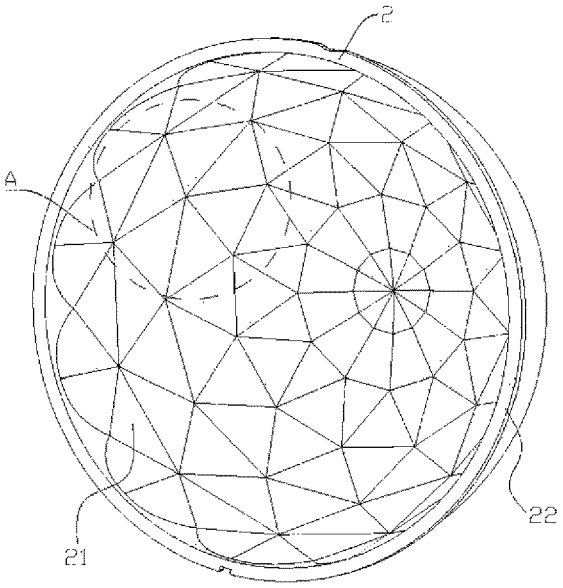
FIG. 6 is a structural schematic diagram of an optical lens.
Figure 7:
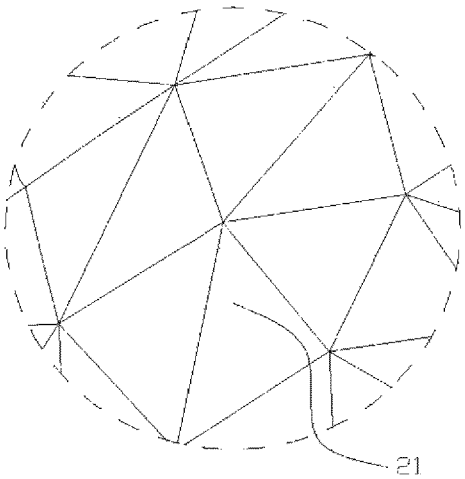
FIG. 7 is an enlarged diagram of a portion A of FIG. 6.

Further with reference to FIG. 6 and FIG. 7, in the present embodiment, the outline of the optical lens 2 is shaped like a semicircular sphere, and a spherical outer surface of the optical lens 2 is a grain-free smooth surface; and the plurality of polyhedral vertebral, prisms 21 are uniformly distributed on a spherical inner surface of the optical lens 2. By means of the above-mentioned structure, the polyhedral vertebral prisms have a function of amplifying the light. After being amplified, the water ripple light patterns form a large-area exceptional and colourful water ripple light pattern effect outside the optical lens 2, which brings a fantastic visual enjoyment to people.

The shape and vertebral height of the polyhedral vertebral prism 21 are set according to an actual requirement. For example, the polyhedral vertebral prism is designed into a regular trihedral vertebra prism, a pentahedral vertebral prism, a hexahedral vertebral prism, and the like. In the present embodiment, specifically, the polyhedral vertebral prism 21 is selectively spliced by a plurality of triangular mirrors to meet an effect of refracting and amplifying the water ripple light pattern.

In the embodiments, the polyhedral vertebral prism 21 is selectively composed of triangular mirrors with different sizes. The inclination degrees of the triangular mirrors are different, and can guide the light to different angles and comprehensively project the light to the exterior of the upper shell 15, and thus, a large range of the water ripple light pattern can be applied to the exterior of the upper shell 15.

In the present embodiment, the starry projection lamp further includes a main control board 82 arranged in the first accommodating cavity 7; both the light-emitting light path system 3 and the laser light path system 4 are electrically connected to the main control board 82; the communication module includes a Bluetooth module and a Wi-Fi module; and a USB module is also arranged on the main control board 82. By means of the above-mentioned structure, due to the arrangement of the audio module, the starry projection lamp also has an audio playing function, so that the user can play audios when using starry projection; an atmosphere with music and dynamic water ripple and static starry patterns is created, so that the user can get lost in the music and light atmosphere to get a full range of relaxation and enjoyment.

Due to the arrangement of the communication module, the user can send an audio signal to the audio module by means of Bluetooth or based on networking or based on USB, and the audio module plays the audios according to the received audio signal.

Both the light-emitting light path system 3 and the laser light path system 4 are electrically connected, to a main board component, so that, the user can control, by means of the main board component, the brightness of the light emitted by the light-emitting light path system 3, and can also control a rotating speed of the light-emitting light path system 3 to control a rotating speed of the water ripple patterns. Water ripple patterns with different light brightnesses and different motion speeds are combined to form various colourful water ripple starry atmospheres, which greatly enhances the visual experience of the user.

By means of the arrangement of the Wi-Fi module, the user can also remotely control on-off states of the light by means of a mobile intelligent terminal (such as mobile phone APP software or intelligent speakers), and can also remotely and regularly control a working state of the starry projection lamp to realize a function of remotely wirelessly adjusting the brightness of the light.

Figure 5:
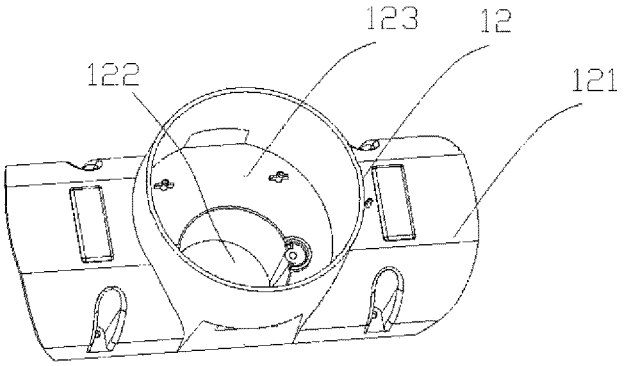
FIG. 5 is a structural schematic diagram of a motor fixing seat of the present disclosure.

Further, with reference to FIG. 4 and FIG. 5, in the present embodiment, the lower shell 1 is in a style of a wide upper part and a narrow lower part; a motor fixing seat 12 is also arranged in the first accommodating cavity 7 of the lower shell 1; the motor fixing seat 12 is provided with a second accommodating cavity; and the light-emitting, light path system 3 is arranged, in the second accommodating cavity. Specifically, a groove 122 and a boss 123 arranged on the groove 122 are arranged in the second accommodating cavity; the motor 51 is arranged on the groove 122; the light-emitting light path system 3 is arranged on the boss 123 by means of the aluminum base plate 31; when the upper shell 15 covers the lower shell 1, the upper shell 15 presses the optical lens 2 on the motor fixing seat 12; and the motor fixing seat 12 is fixed on the lower shell 1. The optical lens 2 has a first block edge 22; the upper shell 15 has a second block edge 151; and when the upper shell 15 covers the lower shell 1, the second block edge 151 presses the first block edge 22. By means of the above-mentioned structure, the optical lens 2 is tightly mounted on the lower shell 1, so that the structure is simple, and the connection is tight.

The motor fixing seat 12 is also symmetrically provided with sound cavities 121; the sound cavities 121 are arranged on two sides of the second accommodating cavity; two loudspeakers 13 in the present embodiment are provided, and are symmetrically disposed about the center of the lower shell 1; the loudspeakers 13 are arranged in the sound cavities 121; an audio module is arranged on the main control board 82; and the loudspeakers 13 are electrically connected to the audio module.

With reference to FIG. 1 and FIG. 2, in the present embodiment, a side wall of the lower shell 1 has an audio opening 14, and the loudspeakers 13 face the audio opening 14. Specifically, there are two audio openings 14, which are symmetrically disposed about the center of the lower shell 1. Due to the arrangement of the loudspeakers 13 in the lower shell 1, and due to the arrangement of the communication module and the USB module, the user can remotely control the starry projection lamp to play songs and other audio files by means of using Bluetooth or Wi-Fi connection, or play audio files by means of USB connection. Further, the user can also control the color and the brightness of the light and the regular on/off functions by means of the Wi-Fi module.

In the present embodiment, the starry projection lamp further includes a key component 8. The key component 8 includes a key 81; the key 81 and the main control board 82 are arranged on the side wall of the lower shell 1, and the key 81 is connected to the main control board 82. By means of the above-mentioned structure, the user can control a working state of the music by clicking the key 81.

The key 81 includes a volume up key/next song key 821, a volume down key/previous song key 822, an audio pause key 823, a USB/Bluetooth switch key 824, a master light switch key 825 and a light brightness adjustment key 826. Specifically, the volume up key/next song key 821 and the volume down key/previous song key 822 are used for controlling the volume of the played audio or switching the played songs; the audio pause key 823 is used for stopping or continuing to carry out the audio playing function; the master light switch key 825 is used for turning on and turning off the light and the audios; and the light brightness adjustment key 826 is used for adjusting the brightness of the light.

Specifically, the starry projection lamp further includes a sound receiving hole 827 and a wireless remote control receiving head 828; the reception hole 827 is used for receiving the audios; and the wireless remote control receiving head 828 is used for receiving a wireless signal sent by a mobile terminal.

In the present embodiment, the side wall of the lower shell 1 is also provided with a charging port 6, and the charging port 6 is used for power supply use for the starry projection lamp.

One or more implementation modes are provided above in combination with specific content, and specific implementations of the present disclosure are not considered to be limited to these illustrations only. Several technical deductions or replacements that are similar to or identical with the methods, structures and the like of the present disclosure, or that are made under the conception of the present disclosure shall all be deemed as falling within the protection scope of the present disclosure.

What is claimed is:

1. A starry projection lamp, comprising an upper shell, a lower shell, a light-emitting light path system used for emitting water ripple light, a laser light path system used for emitting starriness light, and a main control board, wherein the lower shell is provided with a first accommodating cavity; the light-emitting light path system is rotatably disposed; the light-emitting light path system and the laser light path system are arranged in the first accommodating cavity; the upper shell is provided with a first light outlet and a second light outlet; the first light outlet is provided with a light-transmittance optical lens; a plurality of polyhedral vertebral prisms are distributed on an inner surface of the optical lens; a light-emitting surface of the light-emitting light path system faces the polyhedral vertebral prisms; a light-emitting surface of the laser light path system faces the second light outlet; a loudspeaker is also arranged in the first accommodating cavity; a communication module and an audio module are arranged on the main control board; and the loudspeaker is electrically connected to the main control board, a motor fixing seat is also arranged in the first accommodating cavity; the motor fixing seat is provided with a second accommodating cavity; a groove and a boss arranged on the groove are arranged in the second accommodating cavity; a motor is arranged on the groove; the light-emitting light path system is arranged on the boss by means of an aluminum base plate; when the upper shell covers the lower shell, the upper shell presses the optical lens on the motor fixing seat and the motor fixing seat is fixed on the lower shell.

2. The starry projection lamp according to claim 1, wherein the light-emitting light path system comprises the aluminum base plate, a water ripple sheet and a driving component; a plurality of LED lamps are arranged on the aluminum base plate;

light-emitting surfaces of the LED lamps face an illuminated surface of the water ripple sheet; a light-emitting surface of the water ripple sheet faces the polyhedral vertebral prisms; the driving component comprises the motor and an output shaft; the aluminum base plate is sleeved on the output shaft; and the output shaft resists against the water ripple sheet.

3. The starry projection lamp according to claim 1, wherein the motor fixing seat is also symmetrically provided with sound cavities; the sound cavities are arranged on two sides of the second accommodating cavity; and two loudspeakers are provided, and are respectively arranged in the sound cavities.

4. The starry projection lamp according to claim 3, wherein a side wall of the lower shell has audio openings, and the loudspeakers face the audio openings.

5. The starry projection lamp according to claim 3, wherein four LED lamps are provided, and the LED lamps are uniformly distributed around a center of the aluminum base plate.

6. The starry projection lamp according to claim 1, wherein the laser light path system comprises a laser device and a grating sheet, a grating sheet pad is arranged on the laser device, the grating sheet is connected with the grating sheet pad; an illuminated surface of the grating sheet faces a light-emitting surface of the laser device; a light-emitting surface of the grating sheet faces the second light outlet; and a side wall of the laser device is provided with a heat dissipater used for heat dissipation of the laser device.

7. The starry projection lamp according to claim 1, wherein the outline of the optical lens is shaped like a semicircular sphere, and a spherical outer surface of the optical lens is a grain-free smooth surface; and the plurality of polyhedral vertebral prisms are uniformly distributed on a spherical inner surface of the optical lens.

8. The starry projection lamp according to claim 7, wherein the polyhedral vertebral prism is formed by splicing a plurality of triangular mirrors; the mirrors of the polyhedral vertebral prism are divided into a plurality of groups of triangles which are distributed towards an edge along a center of the spherical inner surface of the optical lens, and bottom sides of each group of triangles are spliced to form a dodecagon.

9. The starry projection lamp according to claim 1, wherein the communication module comprises a Bluetooth module and a Wi-Fi module; a USB module is also arranged on the main control board; and both the light-emitting light path system and the laser light path system are electrically connected to the main control board.

* * * * *